United States Patent [19]

Lincoln

[11] Patent Number: 5,051,108

[45] Date of Patent: Sep. 24, 1991

[54] CONNECTOR

[75] Inventor: Thomas C. Lincoln, South Pasadena, Calif.

[73] Assignee: Microdot Inc., Chicago, Ill.

[21] Appl. No.: 659,601

[22] Filed: Feb. 21, 1991

Related U.S. Application Data

[63] Continuation of Ser. No. 495,858, Mar. 19, 1990.

[51] Int. Cl.[5] ..... H01R 13/05

[52] U.S. Cl. ..... 439/825; 439/930

[58] Field of Search ..... 439/851-857, 439/842, 816, 821, 825, 826, 374, 380, 381, 668, 669

[56] References Cited

U.S. PATENT DOCUMENTS

| | | | |
|---|---|---|---|
| 2,647,248 | 7/1953 | Ritter | 439/851 |
| 2,743,428 | 4/1956 | Martines | 439/851 |
| 3,319,217 | 5/1967 | Phillips | 439/825 |
| 3,404,370 | 10/1968 | Bryner et al. | 439/851 |
| 4,921,456 | 5/1990 | French | 439/851 |

*Primary Examiner*—David L. Pirlot

*Attorney, Agent, or Firm*—Lyon & Delevie

[57] ABSTRACT

An electrical connector comprising an improved socket having a longitudinally extending crimped area that reduces the area of contact of a conventional pin therewith.

1 Claim, 1 Drawing Sheet

CONNECTOR

This is a continuation of copending application Ser. No. 07/495,858 filed on Mar. 19, 1990.

BACKGROUND OF THE INVENTION

The present invention relates to electrical connectors and in particular, to a low mating force socket for the acceptance of a multiple spring male twist pin.

Pin and socket connectors are employed in a wide variety of electrical applications, for example, cable connectors, edgeboard connectors, and coaxial cable terminations. In such connectors, one or more pins are arranged on a male connector member and corresponding sockets are arranged on a female connector member. The pins and sockets are dimensioned for cooperative frictional engagement whereby the connector maintains its structural and electrical integrity even after repeated disconnect of the pins from the sockets.

One common form of pin now in use is a "twist pin" which comprises a core of one or more strands formed of, for example, soft copper, surrounded by one or more clusters of beryllium copper spring wire that are helically wound around the core wires. The pin is formed so that the outer wires bulge outwardly. The midsection of the pin has an expanded diameter larger than the inside diameter of the complementary socket. Since the diameter of the expanded cross-section of the pin bundle in its pre-engaged state is greater than the cross-section diameter of the socket, the outer wires of the pin are resiliently compressed to produce a desired contact pressure between the pin and socket when the pin is inserted into the socket. The high degree of resiliency of the socket-engaging wires insures a secure mechanical engagement and a reliable electrical connection as the pin bears against the socket along a substantial interface after insertion into the socket.

In practice, the forces required to engage a given pin and socket are often over 6 ounces of force per contact. While such a force per contact is not significant, per se, it will be appreciated that in a connector employing over a hundred contacts (e.g., over 300 contacts in a whole family of airborne connectors), the overall mating force required to mate the male and female connector members can be very high, even when the contacts have been lubricated. Thus, assembly force limits the number of contacts which can be employed in a connector. Any attempt to alleviate this inconvenience must not result in a reduction in the separation force (i.e., the force needed to separate the pins from their sockets), below a given minimum value, (e.g., 0.5 oz.). Moreover, unless a minimum contact pressure or force is present, the electrical connection across the separatable interface may be compromised.

Efforts to deal with this condition have focused on pin configurations. For example, attempts to solve the problem included the use of coreless pins in which the center or core cable is omitted, use of three cables of four wires, four cables of three wires each, or pins formed of a core of three helically wound wires having 11 or 12 wires helically wound therearound. However, undesirably high engagement forces resulted from each of the aforesaid pin configurations.

Set in the above context, a new approach to the problem of high mating force is required. Normally the socket receiving a twist pin is manufactured with a cylindrical bore having an internal diameter D. The twist pin comprises a compressible spring having a maximum outside diameter greater than D. When inserted into the socket, a controlled amount of spring compression serves to overcome electrical resistance associated with the contact interface by supplying a predetermined contact pressure. Thus, known male sockets have a cylindrical bore wherein all of the active spring members come in contact with the socket wall and start compressing simultaneously.

In contradistinction, the instant invention relates to a connector utilizing a socket wherein the helical nature of the twist pin interacts with localized compression zones to control and reduce mating forces. A socket configured with the circumferentially spaced axially extending compression zones of the instant invention is progressively exposed to the helically arranged springs during the engaging motion.

The three contributing factors exhibited by the connector socket of the instant invention which result in a reduction in engaging force are:

(a) Reduced rub area, (b) Not all springs are fully compressed because of concomitant arrival at a compression site, and (c) The sequential loading of the spring members making contact with the compression site during the engaging motion.

Stated in another manner, a substantial reduction of connector mating force is achieved by shaping the socket to reconfigure the surface rub area encountered when a male twist pin is engaged therewith.

BRIEF DESCRIPTION OF THE DRAWINGS

The objects and advantages of the invention will become apparent from the following detailed description of a preferred embodiment in connection with the accompanying drawing in which like numericals designate like elements, and in which.

DETAILED DESCRIPTION OF THE PREFERRED EMBODIMENT OF THE INVENTION

Figure 1:
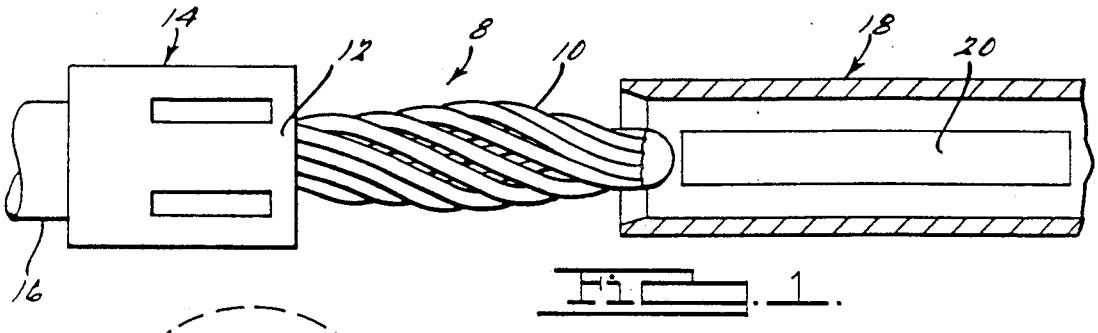
FIG. 1 is a side elevational view, partially in section, of a twist pin and socket prior to assembly.
Figure 6:
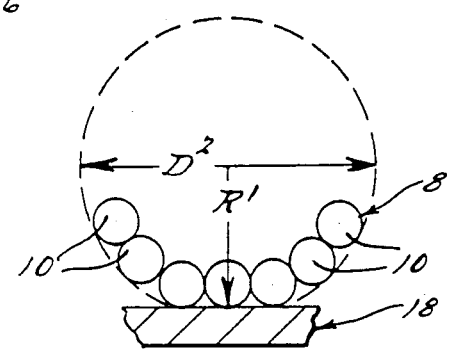
FIG. 6 is a view taken within the circle 6 of FIG. 2 depicting a pin in an engaged condition within a socket.
Figure 2:
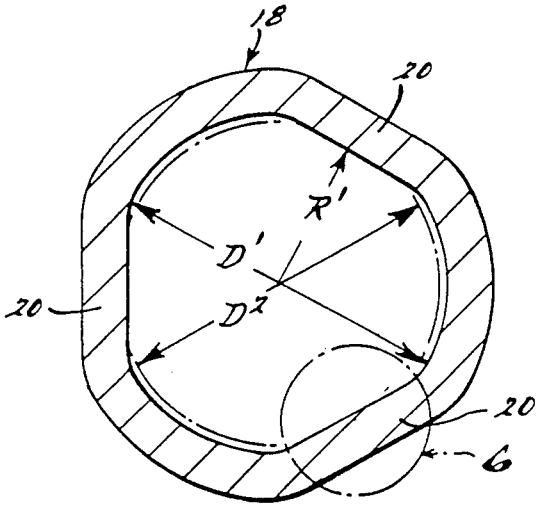
FIGS. 2, 3, 4 and 5 are cross-sectional views which depict four embodiments of the present invention.
Figure 3:
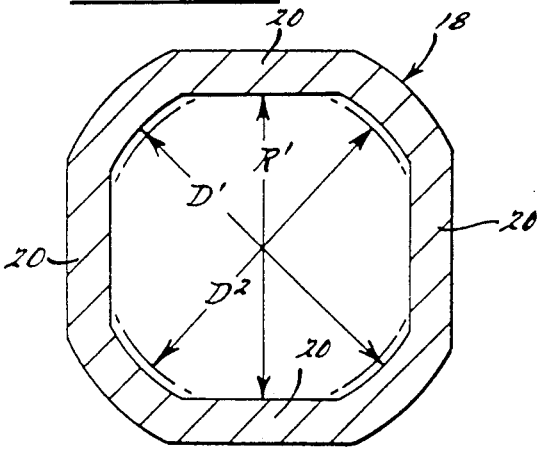
Figure 4:
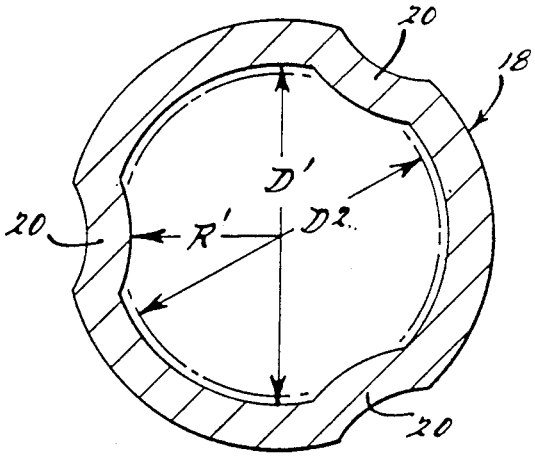
Figure 5:
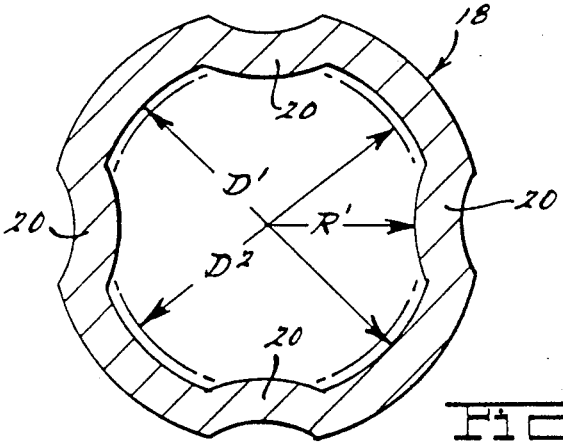

A twist pin 8, which comprises a preferred form of a compliant male contact usable in the connector of the instant invention, is depicted in FIG. 1. The pin 8 comprises a plurality of twisted wire elements 10 secured in the conventional manner within one end 12 of a tubular ferrule 14. The ferrule 14 is formed of an electrically conductive material such as copper. The ferrule 14 is adapted to receive a wire 16 that is welded, soldered or crimped in place whereby the ferrule 14 electrically interconnects the wire 16 and twist pin 8.

In accordance with the present invention, the twist pin 8 is frictionally received within a female socket 18 that is initially formed with an internal diameter $D^1$ approximately equal to the diameter $D^2$ of the pin element 8. The socket 18 is then crimped at one or more circumferentially spaced longitudinally extending locations 20 to an internal radius $R^1$ whereby $2 \times R^1$ is less than the maximum diameter $D^2$ of the pin 8. The socket 18 is also provided with an electrically conductive lead (not shown) in the conventional manner.

In field use of a connector made in accordance with the instant invention, it has been discovered that high engagement forces are alleviated incident to engagement of a standard twist pin 8 in a socket 18 having the cross-sectional configuration shown in FIGS. 2–5 of the drawing.

Specifically, the crimped areas 20 of the socket 18 reduce the total contact area of the wire elements 10 in engagement with the socket 18. Notwithstanding the foregoing, it has been found that required minimum separation forces are maintained at the electrical interface. Moreover, no loss of electrical conductivity has been exhibited by the reduction in overall area of engagement between the outer wires 10 of the pin 8 and the crimped area 20 of the socket 18 due to the reduction of contact area.

Significantly, the aforesaid advantages are achieved by a pin 8 which is of standard configuration and thus can be fabricated by known methods.

From the foregoing, it will be appreciated that the present invention provides a connector in which the pin is significantly easier to assemble within its complementary socket. This result is achieved without departing from conventional, proven pin configurations or compromising electrical integrity of the connector.

While the preferred embodiment of the invention has been disclosed, it should be appreciated that the invention is susceptible of modification without departing from the scope of the following claims.

I claim:

1. An electrical connector comprising a compliant twist pin comprising a plurality of helically twisted wires connected to one another at longitudinally spaced end portions thereof, the wires at an intermediate portion of said twist pin being initially circumferentially spaced from one another and extending radially to a radius R, and a noncompliant circumferentially closed cylindrical socket having a first plurality of circumferentially spaced longitudinally extending internal surfaces disposed at a radius greater than R and a second plurality of circumferentially spaced longitudinally extending internal surfaces between said first surfaces, respectively, and disposed at a radius less than R whereby the intermediate portions of some of said wires make initial contact with only the second plurality of internal surfaces on said socket and are radially compressed to a diameter less than R thereby to minimize the force required to assemble said pin in said socket yet provide contact pressure between said pin and socket.

* * * * *